United States Patent [19]

Myles

[11] 4,024,987

[45] May 24, 1977

[54] DEVICE FOR HEATING LATHER PRODUCT FROM A PRESSURIZED CONTAINER

[76] Inventor: James Myles, 6061 Yonge St., Apt. 709, Willowdale, Ontario, Canada

[22] Filed: Mar. 26, 1976

[21] Appl. No.: 670,960

[52] U.S. Cl. ..... 222/146 HA; 222/148

[51] Int. Cl.[2] ..... B67D 5/62

[58] Field of Search ... 222/146 H, 146 HA, 146 HS, 222/190, 148

[56] References Cited

UNITED STATES PATENTS

| | | | |
|---|---|---|---|
| 2,873,351 | 2/1959 | Lannert | 222/146 HA |
| 3,184,114 | 5/1965 | Minear | 222/146 HA |
| 3,258,170 | 6/1966 | Ayres et al. | 222/146 HA |
| 3,388,958 | 6/1968 | Modla | 222/146 HA |

*Primary Examiner*—Stanley H. Tollberg
*Assistant Examiner*—Hadd Lane
*Attorney, Agent, or Firm*—Joel Halpern

[57] ABSTRACT

A device for heating shaving lather from a pressurized container and for supplying hot lather includes a housing within which there is a hot water reservoir and a coil connected between an inlet and an outlet for the lather. A hot water inlet is adapted to suspend the device from a water faucet and supply hot water to the hot water inlet. An adapter is secured to the lather inlet for detachably connecting same to the water faucet for purging of the coil.

6 Claims, 3 Drawing Figures

DEVICE FOR HEATING LATHER PRODUCT FROM A PRESSURIZED CONTAINER

BACKGROUND OF THE INVENTION

The present invention relates to a device for heating lather supplied from a pressurized container and more particularly to such a device which provides for a continuous supply of hot water and purging of the heat exchanger.

Devices for the heating of lather and foam products from pressurized containers such as aerosol-type dispensers have been well known heretofore. U.S. Pat. Nos. 3,175,733 issued Mar. 30, 1965 to N. B. Lerner and 3,241,724 issued Mar. 22, 1966 show two such prior devices. Thus, the importance of heating lathers such as shaving lather to enhance its use was clearly recognized prior to the present invention. However, the earlier devices relied upon the provision of intermittent batches or quantities of water for heating of the heat exchange coil, supported the device from the pressurized container, and did not afford a simple, if any, means for purging or cleansing of the lather conduit; i.e., the coil so as to ameliorate problems of plugging and the like. It must be appreciated that since devices of this character involve the presence of lather within the coil for prolonged periods of time when the device is not in use there is a high susceptibility to clogging of the coil with hardened portions of lather. The device is thereafter rendered less efficient or substantially inoperative. Also, the refilling of the water reservoir with hot water was periodically required with prior devices in order to insure a sufficient temperature gradient visa vis the water in the reservoir and the lather in order to effect a sufficient heat transfer.

SUMMARY OF THE INVENTION

It is one object of this invention to provide a device for heating a lather product from a pressurized container which maintains a sufficient temperature gradient in the heat exchanger to insure the discharge of a heated lather.

It is another object of the invention to provide a device of the character described which can be simply supported on a convenient supply of continuous hot water.

It is still another object of the invention to provide a device of the aforesaid character which affords a simple means for purging or cleansing the heat exchanger.

Other objects and advantages of the invention will become readily apparent from the following description of the invention.

BRIEF DESCRIPTION OF THE INVENTION

In order that the invention may be more fully comprehended it will now be described, by way of example, with reference to the accompanying drawings in which.

DETAILED DESCRIPTION OF THE INVENTION

Figure 1:
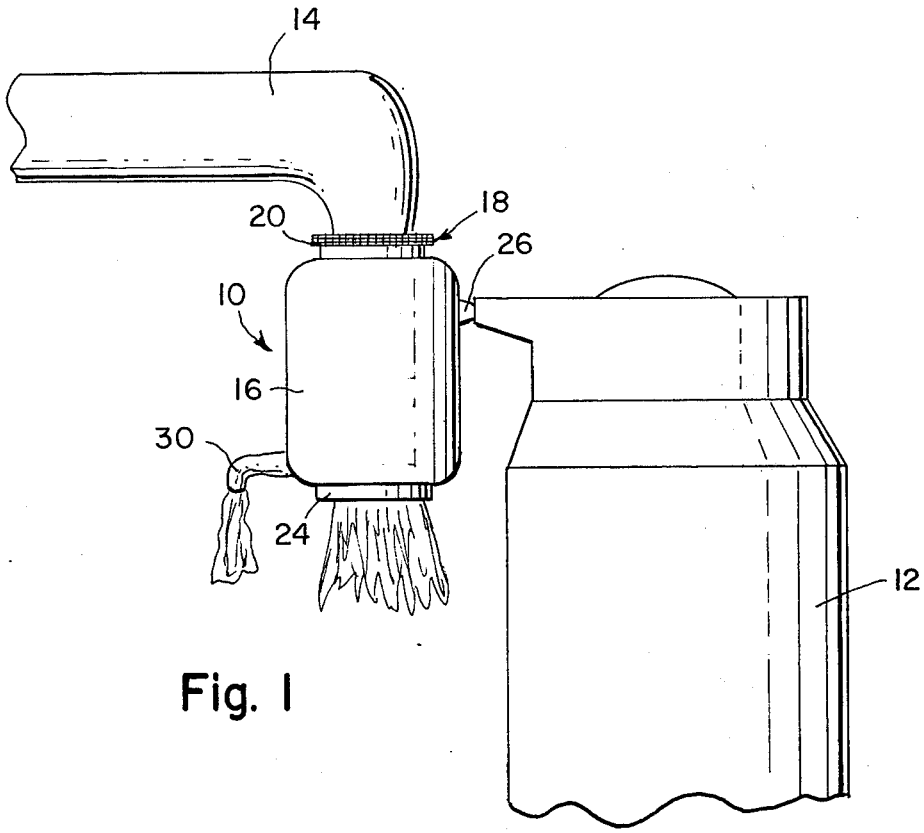
FIG. 1 is a schematic illustration of the device of the invention operatively connected to a source of heat exchange fluid and an aerosol-type dispenser.

Referring to the drawings there is shown a device 10 for heating a lather product such as a shaving lather from a pressurized container 12 which may be an aerosol-type dispenser or the like within which the product is stored under the pressure of a propellant gas. However, the present invention is applicable to any type of pressurized container capable of discharging or dispensing the lather product to be used by a person in a heated state.

The device of the invention is shown in FIG. 1 as being supported on the discharge end of a hot water faucet 14. The device includes a housing 16 which may desirably be constructed in the form of a generally cylindrical vessel. A hot water inlet 18 is preferably formed in the upper portion of the housing and includes means for detachably supporting the device on the water faucet and for connecting the inlet with a continuous supply of the heat exchange fluid. As shown, the inlet is provided with a fitting 20 which is secured to the inlet and is given an internal thread 22 so that it can be threaded onto the threaded end of a faucet. It will be understood, of course, that the fitting 20 and the adapter 28 to be later described can be mounted on the device as by means of a universal connection to be pivotable freely. These elements may be formed of any suitable material including metal, plastics or rubber. The internal bore of the fitting is in axial alignment with the bore of the water inlet in the housing such that a continuous supply of hot water can be furnished to the device. The housing is also provided, preferably in an opposed portion from that at which the water inlet is positioned, with an outlet 24 for the discharge of water from the device when in operation.

Figure 2:
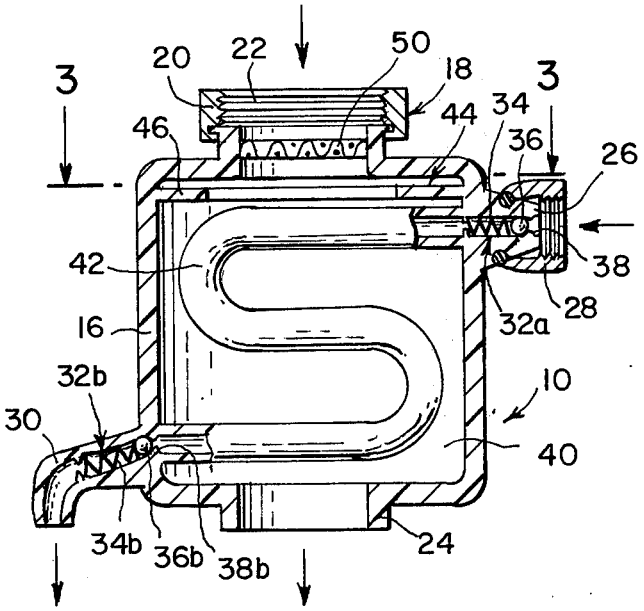
FIG. 2 is a side elevational view, partly in cross-section, of the device shown in FIG. 1.
Figure 3:
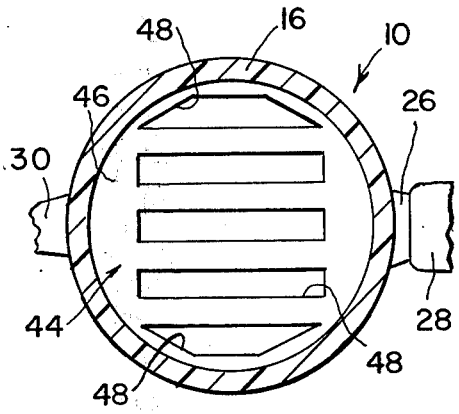
FIG. 3 is a fragmentary top plan view, partly in cross-section, of the device shown in FIG. 2 taken along line 3—3 thereof.

The housing is given a lather inlet 26 which may, as shown in FIGS. 1–3, be tapered so as to afford a convenient means for detachably connecting the device to the pressurized container 12. The lather inlet includes an axial bore for passage of the lather under pressure therethrough. Secured to the inlet 26 for the lather there is an adapter element 28 which may be retained flexibly on the outer surface of the inlet so as not to interfere with the coupling of the device with the pressurized container. The adapter, however, does provide a substantially water-tight seal with the outer surface of the inlet and, similar to fitting 20, may be internally threaded in order to connect the lather inlet with the hot water supply for purging or cleansing of the heat exchange element as will be hereinafter described.

The housing is also provided with a lather discharge outlet 30 for emitting the heated lather product. As can be seen most clearly from FIG. 2, the inlet and outlet for the lather are each given a valve 32*a* and *b* respectively such as a spring-biased ball valve in order to prevent lather already within the device from leaking therefrom during times when the device is not in use. As can be seen from FIG. 2, the valve 32*a* will prevent the leakage of lather due to the bias of spring 34 retaining ball element 36 on its seat 38 until forced inwardly under the pressure of the lather discharged from the pressurized container. Similarly, spring 34*b* of valve 32*b* will retain ball element 36*b* upon its seat 38*b* until lather is discharged from the pressurized container. At such time the pressure of the lather will unseat ball 36*b* and permit the discharge of heated lather from outlet 30.

The housing defines a hot water reservoir 40 therein and is configured internally so as to maintain a level of hot water covering a substantial portion of heat exchange coil 42 mounted within the reservoir. The coil 42 is sealingly connected between the inner ends of the lather inlet 26 and the lather outlet 30 and is dimensioned to permit the passage of lather therethrough with a minimum resistance when the pressurized container is activated in order to propel a charge of lather to and through the device. The coil is arranged within the reservoir in serpentine form so as to provide a sufficient heat exchange area to insure that adequate heat from the hot water in the reservoir is transferred to the lather to raise the temperature of the lather to the desired level. In order to afford optimum distribution of the hot water flowing from the water inlet across the coil, so as to maximize heat transfer, a water deflector 44 is mounted within the housing above the coil. The deflector in its preferred form comprises a plate 46 having a plurality of parallelly disposed slots 48 therein which effect a metering of the flowing hot water and direct the same to the surfaces of the coil. For reasons which will be apparent to persons versed in the art and in the construction of heat exchangers, coil 42 should be made of a material having a high coefficient of heat conductivity. Aluminum, for example, would be quite satisfactory.

If desired a filter screen 50 may be mounted within the water inlet 18 directly above the water deflector.

In order to cleanse the coil 42 periodically of lather which may accumulate therein and reduce the throughput of the device one need simply disconnect fitting 20 from the faucet and connect the adapter 28 to the faucet. The hot water will then be caused to flow through the coil and be discharged from outlet 30 together with the lather which has remained within the coil from the last use of the device.

From the foregoing it will be seen that a device has been provided for supplying heated lather, such as a shaving lather, which can conveniently be supported on a water faucet for a continuous supply of hot water therefrom, the device being so constructed as to afford a simple means for cleansing the heat exchange coil of accumulated lather therein which may cause plugging of the device.

I claim:

1. A device for heating lather dispensed from a pressurized container and for thereby supplying hot lather, comprising in combination:

a housing defining a hot water reservoir therein and having a hot water inlet at one end thereof adapted to releasably support the housing on and operatively connect said water inlet to a water faucet, an outlet for discharging water remote from said water inlet, a lather inlet adapted to be operatively connected to the discharge outlet of a pressurized lather container and having valve means therein for preventing discharge of heated lather from within the housing, and a hot lather discharge outlet for discharging hot lather therefrom and having valve means therein for preventing leakage of hot lather therefrom below a predetermined pressure;

a coil mounted within said housing between said water inlet and said water outlet sealingly connected between said lather inlet and said lather outlet;

means for releasably and coaxially connecting the lather inlet of the device to a water faucet for the admission of purge water directly into said coil;

and a water deflector mounted within said housing above said coil for directing hot water entering said housing to said coil.

2. A device according to claim 1, including an adapter secured to said lather inlet for detachably connecting same to the water faucet for purging of said coil.

3. A device according to claim 1, wherein said hot water inlet includes a threaded section cooperable with threads on the water faucet for detachably supporting said housing on said water faucet and for supplying hot water to said water inlet.

4. A device according to claim 1, wherein said water inlet and said water outlet are positioned in opposed portions of said housing.

5. A device according to claim 1, including a filter screen element mounted in said water inlet above said water deflector.

6. A device according to claim 1, wherein said valve means of said lather inlet and lather outlet comprise spring-biased one way ball valves.

* * * * *